US006185790B1

(12) United States Patent
Stahlecker

(10) Patent No.: US 6,185,790 B1
(45) Date of Patent: Feb. 13, 2001

(54) ARRANGEMENT FOR CONDENSING A DRAFTED FIBER STRAND

(75) Inventor: Hans Stahlecker, Haldenstrasse 20, 73079 Suessen (DE)

(73) Assignees: Fritz Stahlecker, Bad Überkingen; Hans Stahlecker, Süssen, both of (DE)

( * ) Notice: Under 35 U.S.C. 154(b), the term of this patent shall be extended for 0 days.

(21) Appl. No.: 09/362,744

(22) Filed: Jul. 29, 1999

(30) Foreign Application Priority Data

Aug. 17, 1998 (DE) ..... 198 37 181

(51) Int. Cl.[7] ..... D01H 5/86

(52) U.S. Cl. ..... 19/246; 19/244; 19/236; 19/150

(58) Field of Search ..... 19/150, 236, 237, 19/238, 239, 240, 241, 242, 243, 244, 245, 246, 247, 248, 249, 250, 252, 263, 286, 287, 288, 304, 305, 306, 307, 308

(56) References Cited

U.S. PATENT DOCUMENTS 5,600,872 2/1997 Artzt et al. .

FOREIGN PATENT DOCUMENTS

4139067C2 6/1993 (DE) .

*Primary Examiner*—John J. Calvert
*Assistant Examiner*—Gary L. Welch
(74) *Attorney, Agent, or Firm*—Evenson, McKeown, Edwards & Lenahan, P.L.L.C.

(57) ABSTRACT

A condensing zone for condensing a drafted twist-free fiber strand is arranged downstream of a drafting arrangement of a ring spinning machine. The condensing zone includes a stationary sliding surface having a suction slit extending essentially in a fiber strand transport direction. A perforated transport belt transports the fiber strand over the suction slit of the sliding surface. The transport belt wraps around a bottom roller of a front roller pair of the drafting arrangement and is driven by the bottom roller. The transport belt drives in turn a nipping roller, which limits the condensing zone on its exit side with a nipping point serving as a twist block. The nipping roller presses the fiber strand and the transport belt against the sliding surface of the condensing zone.

15 Claims, 2 Drawing Sheets

ARRANGEMENT FOR CONDENSING A DRAFTED FIBER STRAND

BACKGROUND AND SUMMARY OF THE INVENTION

This application claims the priority of German application 198 37 181.0, filed in Germany on Aug. 17, 1998, the disclosure of which is expressly incorporated by reference herein.

The present invention relates to an arrangement for condensing a drafted fiber strand in a condensing zone arranged downstream of a front roller pair of a drafting unit, which condensing zone comprises a stationary sliding surface having a suction slit extending essentially in transport direction, also comprising a perforated transport belt which transports the fiber strand over the sliding surface, to which transport belt a nipping roller, limiting the condensing zone on its exit side, is arranged.

An arrangement of this type is prior art in the U.S. Pat. No. 5,600,872. A driven delivery roller pair is arranged downstream of the front roller pair of the drafting unit, the transport belt being wrapped around the top roller of the delivery roller pair and being driven by same. A condensing zone is located between the front roller pair of the drafting unit and the delivery roller pair, which condensing zone comprises a suctioned sliding surface, over which the transport belt is guided. The transport belt has centrical perforations in the transport direction, through which perforations a suction air stream passes. The size of the perforation of the transport belt corresponds to the desired degree of condensing of the fiber strand. When the drafted, twist-free fiber strand is condensed, the outwardly projecting edge fibers are rolled in around the core strand, so that the fiber strand becomes smoother and less hairy. When the twist is subsequently imparted, a yarn results which is smoother and more tear resistant.

In the known arrangement it is disadvantageous that the size of the perforation determines the condensing effect and has to be adapted to the desired fineness of the yarn to be spun. It is furthermore disadvantageous that the suction slit, over which the transport belt slides, cannot reach to the nipping point limiting the condensing zone on its exit side. This means that when the yarn reaches the delivery roller pair a part of the condensing effect is lost.

In the German published patent 41 39 067 C2 it is disclosed that the fiber strand is guided in the condensing zone by means of a non-perforated apron pair, of which one apron each wraps around a roller of the front roller pair of the drafting unit. This apron pair guides the fiber strand into a delivery roller pair arranged downstream, of which the top roller takes the form of a suction roller. The lower apron of the condensing zone also wraps around the bottom delivery roller, while the suction roller in the form of a top roller of the delivery roller pair is not wrapped by an upper apron. In this embodiment, the suction slit is located in the inside of the suction roller, so that really the actual condensing effect first occurs in this area.

It is an object of the present invention to provide a transport belt which is to a great extent independent of the thread unit to be spun, whereby the drive of the transport belt is such that the suction slit extends to the twist block.

This object has been achieved in accordance with the present invention in that the transport belt is driven by a roller of the front roller pair and is pressed onto the sliding surface by the nipping roller.

A drive of this type, in contrast to the prior art described above, permits the extension of the suction slit to the nipping point, so that the condensing effect is not lost before the spinning twist is imparted. The suction air stream becomes then particularly homogenous when the transport belt is designed as a very finely perforated woven belt, for example, made from polyamide filaments.

The transport belt accordingly wraps around a driven bottom roller of the front roller pair, whereby the condensing zone is completely draft-free. The transport belt can drive hereby in turn the nipping roller, which then requires no further drive.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
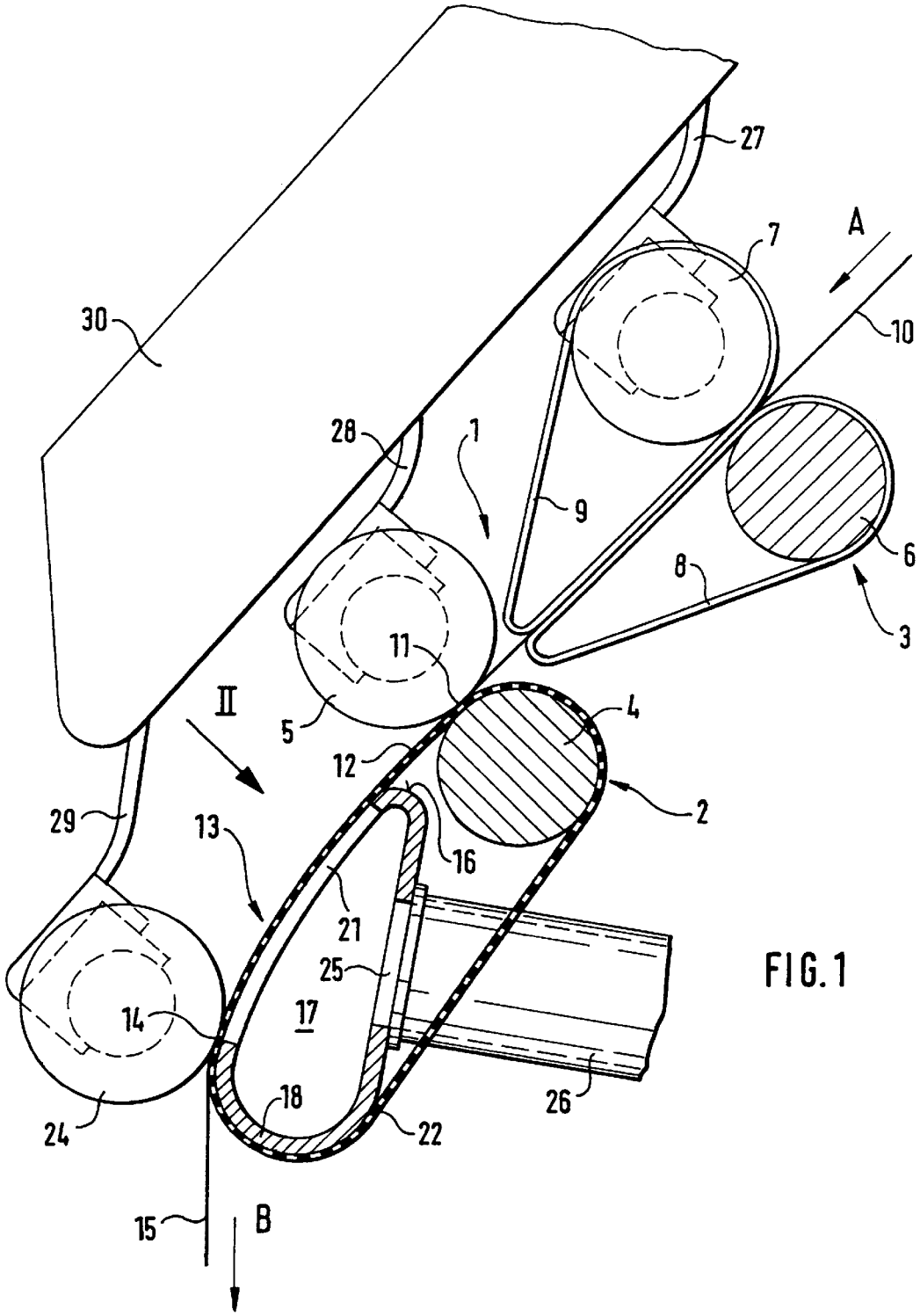
FIG. 1 is a partly intersectional side view onto the area of a condensing zone of a ring spinning machine and constructed according to preferred embodiments of the invention.
Figure 2:
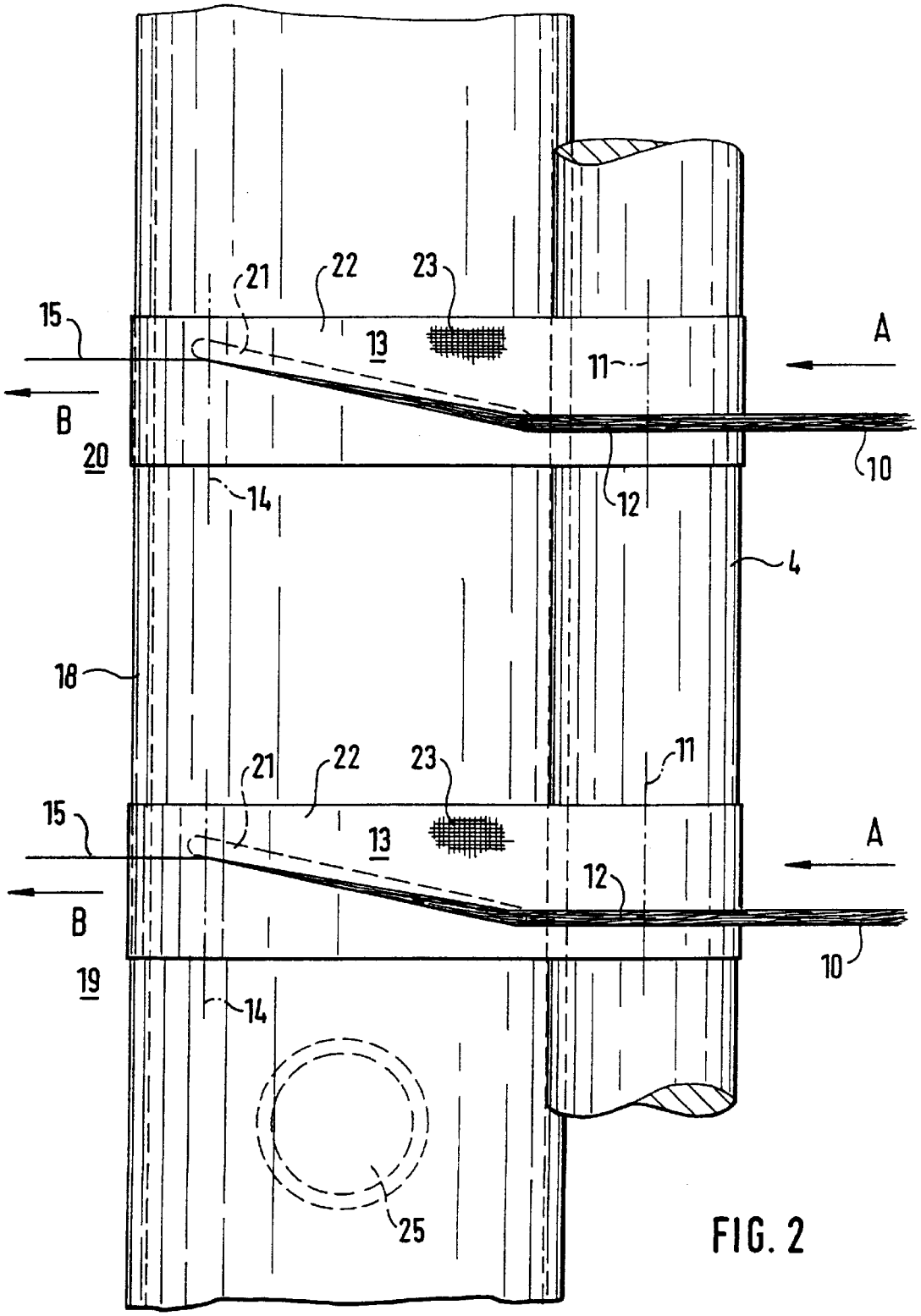
FIG. 2 is a view in the direction of the arrow 11 of FIG. 1 onto the condensing zone.

Of the ring spinning machine comprising an arrangement for condensing, only the area at the exit of a drafting unit 1 is shown, of which only the front roller pair 2 and the apron roller pair 3 arranged upstream thereof are shown. The front roller pair 2 comprises a driven bottom roller 4, which takes the form of a continuous bottom roller extending in machine longitudinal direction, and a top roller 5 pressed flexibly against the bottom roller 4. The apron roller pair 3 also comprises an apron lower roller 6 as well as an apron top roller 7. The rollers are surrounded by a bottom apron 8 and an upper apron 9 respectively.

In the drafting unit 1, a sliver or roving 10, which is fed in transport direction A, is drafted to the desired degree in a known way. The front roller pair 2 forms a nipping point 11, from which a drafted, but twist-free fiber strand 12 exits. From the nipping point 11 onwards a condensing zone 13 begins, which is arranged downstream of the drafting unit 1, which condensing zone 13 bundles the fiber strand 12 by means of condensing and thus makes the fiber strand smoother and less hairy. The condensing zone 13 is limited on its exit side by means of a further nipping point 14.

From the nipping point 14 onwards, a spinning twist is imparted to the yarn 15 to be spun. The yarn 15 hereby reaches a ring spindle (not shown) in delivery direction B.

The condensing zone 13 comprises a sliding surface 16, which is a component of a suction device 17. The suction device 17 is formed by, among others, a hollow profile 18, which extends over a plurality of spinning stations 19, 20. Advantageously, one hollow profile 18 is arranged at each machine section. The outer contour of the hollow profile 18 is designed as the above mentioned sliding surface 16.

The sliding surface 16 has one suction slit 21 per spinning station 19, 20, which suction slit is disposed slightly transversely to the transport direction A. The length of the suction slit 21 reaches up to the second nipping point 14, while the other end of the suction slit 21 begins directly downstream of the first nipping point 11. The width of the suction slit 21 is somewhat wider than the ready condensed fiber strand 12.

A perforated transport belt 22 transports the fiber strand 12 to be condensed over the sliding surface 16 and the respective suction slit 21. The suction device 17 generates a suction air stream, which passes through the perforation 23 of the transport belt 22 and hereby pulls the fiber strand 12 to be condensed onto the transport belt 22. On the side of the hollow profile 18 facing away from the suction slit 21 is located per machine section one suction opening 25, which is connected by means of a connection 26 to a vacuum source (not shown).

The condensing zone 13 is limited by a nipping roller 24, which presses the transport belt 22 and the fiber strand 12 against the sliding surface 16, said nipping roller 24 thus acting as a twist block. As the nipping point 14 is not formed by a roller pair, but rather together with a stationary sliding surface 16, the suction slit 21 can extend to the nipping point 14.

The apron top roller 7, the top roller 5 of the front roller pair 2 as well as the nipping roller 24 are each loaded by means of a loading spring 27,28 and 29 respectively. These loading springs 27,28 and 29 are supported in a loading support 30 in a known way.

The transport belt 22 wraps around the bottom roller 4 of the front roller pair 2 and is driven by the former. The transport belt 22 drives in turn the nipping roller 24, which hereby attains exactly the same circumferential speed as the front roller pair 2. Thus the condensing zone 13 remains draft-free.

As the transport belt 22 is designed as a woven belt, it can be made finely perforated in such a way that a compelety homogenous air suction stream arises.—This is particularly advantageous for the condensing effect. The desired bundling which occurs during condensing of the fiber strand 12 thus is not controlled by means of the perforation 23, but rather by means of the dimension of the suction slit 21.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An arrangement for condensing a drafted fiber strand in a condensing zone arranged downstream of a front roller pair of a drafting unit, which condensing zone comprises:

a stationary sliding surface having a suction slit extending essentially in a fiber strand transport direction, a perforated transport belt which transports the fiber strand over the sliding surface, and a nipping roller which in use presses the fiber strand against the belt, thereby limiting the condensing zone on an exit side thereof, wherein the transport belt is driven in use by a roller of the front roller pair and is pressed onto the sliding surface by the nipping roller.

2. An arrangement according to claim 1, wherein the roller of the front roller pair is a driven bottom roller, and wherein the transport belt in use wraps around said driven bottom roller.

3. An arrangement according to claim 2, wherein the transport belt in use drives the nipping roller.

4. An arrangement according to claim 2, wherein the transport belt is designed as a woven fabric belt.

5. An arrangement according to claim 1, wherein the transport belt in use drives the nipping roller.

6. An arrangement according to claim 3, wherein the transport belt is designed as a woven fabric belt.

7. An arrangement according to claim 1, wherein the transport belt is designed as a woven fabric belt.

8. A ring spinning arrangement including a fiber strand drafting unit, with a front drafting roller pair at a downstream end of the drafting unit, and a condensing unit disposed downstream of the drafting unit, said condensing unit comprising:

a stationary sliding surface having a suction slit extending essentially in a fiber strand transport direction, a perforated transport belt which transports the fiber strand over the sliding surface, and a nipping roller which in use presses the fiber strand against the belt, thereby limiting the condensing zone on its exit side, wherein the transport belt is driven in use by a roller of the front roller pair and is pressed onto the sliding surface by the nipping roller.

9. A ring spinning arrangement according to claim 8, wherein the roller of the front roller pair is a driven bottom roller, and wherein the transport belt in use wraps around said driven bottom roller.

10. A ring spinning arrangement according to claim 9, wherein the transport belt in use drives the nipping roller.

11. A ring spinning arrangement according to claim 10, wherein the transport belt is designed as a woven fabric belt.

12. A ring spinning arrangement according to claim 9, wherein the transport belt in use drives the nipping roller.

13. A ring spinning arrangement according to claim 9, wherein the transport belt is designed as a woven fabric belt.

14. A ring spinning arrangement according to claim 8, wherein the transport belt in use drives the nipping roller.

15. A ring spinning arrangement according to claim 8, wherein the transport belt is designed as a woven fabric belt.

* * * * *